US007303444B2

(12) United States Patent
Denpouya

(10) Patent No.: US 7,303,444 B2
(45) Date of Patent: Dec. 4, 2007

(54) ELECTRICAL CONNECTOR

(75) Inventor: Ikuo Denpouya, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/583,154

(22) Filed: Oct. 19, 2006

(65) Prior Publication Data

US 2007/0123088 A1 May 31, 2007

(30) Foreign Application Priority Data

Nov. 30, 2005 (JP) ..... 2005-346030

(51) Int. Cl.
*H01R 24/00* (2006.01)

(52) U.S. Cl. ..... 439/660; 439/694; 439/902

(58) Field of Classification Search ..... 439/660, 439/694, 881, 885, 902
See application file for complete search history.

(56) References Cited

U.S. PATENT DOCUMENTS 4,130,330 A * 12/1978 Chandler ..... 439/358
5,713,754 A * 2/1998 Samejima et al. ..... 439/374
6,663,415 B1 * 12/2003 Wu ..... 439/460
6,890,189 B1 * 5/2005 Wu ..... 439/76.1
2004/0002265 A1 * 1/2004 Shimizu et al. ..... 439/660

FOREIGN PATENT DOCUMENTS

JP 2002-033150 1/2002

OTHER PUBLICATIONS

European Seach Report, Mar. 19, 2007.

* cited by examiner

*Primary Examiner*—Tho D. Ta
*Assistant Examiner*—Travis Chambers
(74) *Attorney, Agent, or Firm*—Takeuchi & Kubotera, LLP

(57) ABSTRACT

A electrical connector includes a housing (11) with a peripheral wall and a front projection (17) that extends from said peripheral wall in the plugging direction so as to plug in a dent portion (43) of a mating connector (30) thereby providing a large plugging length without increasing the connector size.

9 Claims, 6 Drawing Sheets

ELECTRICAL CONNECTOR

BACKGROUND OF THE INVENTION

1. Field of the Invention

This invention relates to an electrical connector having a plug-in face with a mating electrical connector, which is provided in a peripheral wall of a housing and extends in a plug-in direction of the connector.

2. Description of the Related Art

This kind of electrical connector is disclosed in, for example, Japanese Patent Application Kokai Number 2002-33150. It discloses a board-side connector, which is fixed to a circuit board, and a cable connector, which is plugged-in the board-side connector and furnished with a cable. The housing of the board-side connector has an appearance of a substantially rectangular parallelepiped. The housing comprises a hollow opened upwardly for receiving the cable connector or a mating connector. One of four sidewalls forming the hollow is opened sideways within the full range of the depth of the hollow. When the cable connector is plugged-in the board-side connector from the above, the cable of the cable connector extends from a side opening of the hollow of the board-side connector.

Since, as described above, one of the four sidewalls of the hollow of the board-side connector is opened sideways widely, the cable connector is guided by the plug-in faces formed on the internal surfaces of the remaining three sidewalls of the hollow. Since the three plug-in faces are formed in the same range of height, the plug-in between both the connectors starts and finishes simultaneously at the three plug-in faces.

The plug-in face that is long in the plug-in direction is generally preferable. Especially, when the cable of the cable connector extends sideways, since part of the peripheral wall of the housing is opened for extension of the cable, the plug-in face becomes small in area. Accordingly, a lengthy plug-in face is required to secure large area for the plug-in. In the example in Patent Document 1, since the three plug-in faces are provided in the same range in the plug-in direction, the plug-in operation starts and finishes simultaneously at all the plug-in faces. Accordingly, if a connector with large dimension in the plug-in direction is acceptable, a large plug-in length is allowed. However, if a small dimension of connector is required, the plug-in length becomes too large.

SUMMARY OF THE INVENTION

Accordingly, it is an object of the present invention to provide an electrical connector having a sufficient plug-in length with small dimension in the plug-in direction.

The present invention relates to first and second connectors that are plugged in each other.

First Connector:

The first connector includes a housing with a peripheral wall and a plug-in face provided on the outer surface of the peripheral wall and extended in the plug-in direction. A cable extends in a direction perpendicular to the plug-in direction. The housing includes a front projection extending in the plug-in direction from the front end of the housing for being plugged in a dent portion of a mating connector.

The front projection cooperates with other plug-in faces for plugging guidance. That is, the plug-in length is elongated by the front projection. The front projection is provided on such a portion of the front face of the housing that the strength of a bottom wall of the housing is not affected.

Thus, the connector with a cable can have a satisfactory plug-in face upon plug-in with the mating connector.

It is preferred that the front projection is provided on an even number of corners of the housing so that the distance between the front projections can be maximized and oblique plugging between the connectors is minimized.

A peripheral projection projects from the peripheral wall in a direction perpendicular to the plug-in direction and plugged in a plug-in space provided in the peripheral wall of a mating connector. By providing the peripheral projection within the wall of the connector, it is possible to provide not only a large plug-in face without increasing the width of the connector but also a large plug-in length in cooperation with the front projection. The peripheral projection may be provided on each of opposed side walls of the housing. It is preferred that the peripheral projections are spaced as far as possible so that inclined plugging can be prevented.

The peripheral projection is made so as to serve as a cable extension from which a cable extends in the same direction as the peripheral projection. Thus, it has two functions; i.e., plugging guidance and cable support.

Two peripheral projections are provided on each of opposed side walls of the housing so that the housing has an H-shaped form as viewed in the plugging direction.

Second Connector:

A plug-in face is provided on an inner surface of a peripheral wall of a housing of the second connector and extends in the plugging direction. A cut-off portion is provided in the sidewall so as to allow the extension of a cable in a direction of the plugging direction. A dent portion is provided in the bottom of the housing for receiving the front projection of the first connector.

The dent portion works with the front projection of the first connector for plugging guidance. It increases the plugging length as the front projection does. It is provided in a portion of the bottom so that it neither decreases the bottom strength nor increases the connector height because it is made in the bottom wall.

It is preferred that the dent portion is provided in each of an even number of corners of the bottom. Since they are provided at the corners, the distance between them is maximized so that the inclined plugging is minimized. The plug-in space is made in the peripheral wall for receiving the peripheral projection of the first connector.

By making the plug-in space within the wall thickness, it is possible to provide a large plug-in face and maximize the plug-in length in cooperation with the dent portion. The plug-in space may be provided in each of opposed sidewalls of the housing. The plug-in spaces are spaced so much that inclined plugging is prevented.

The plug-in space may be a groove portion extending halfway in the sidewall or a cut-off portion passing through the sidewall. Both the groove portion and the cut-off portion work as plugging guidance. In addition, the cut-off portion receive the cable extension.

One of opposed sidewalls of the housing has a pair of groove portions and the other has a pair of cut-off portions so that the plug-in space has an H-shaped form as viewed in the plugging direction.

BRIEF DESCRIPTION OF THE DRAWINGS

FIG. 1 is a perspective view of a pair of electrical connectors according to the first embodiment of the present invention showing the condition before plug-in;

DESCRIPTION OF THE PREFERRED EMBODIMENTS

The embodiments of the present invention will now be described with reference to the accompanying drawings.

Figure 1:
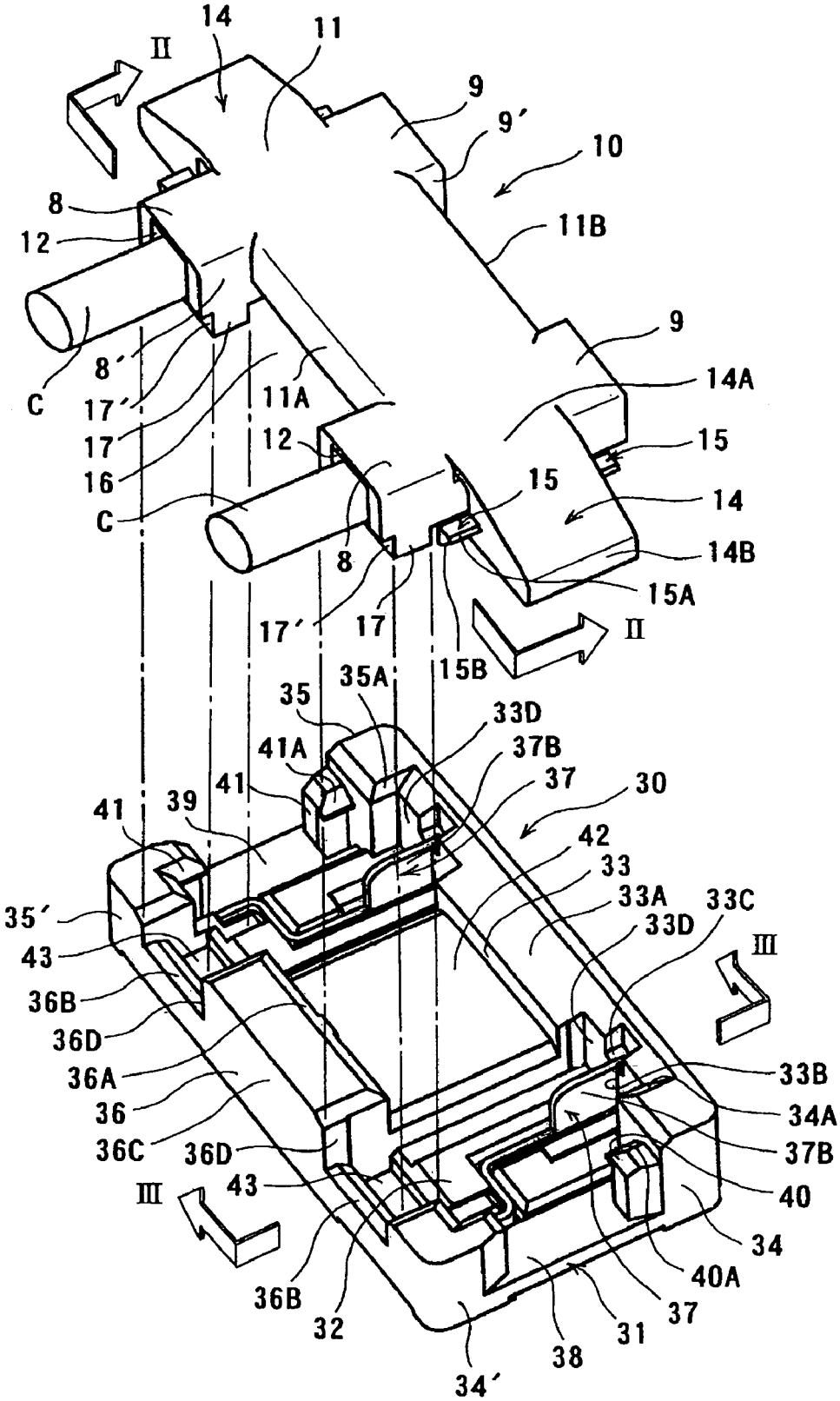

In FIG. 1, the first electrical connector 10 comprises a housing 11 of a rectangular parallelepiped with longitudinal sidewalls 11A and 11B in an arrangement direction of terminals. Two peripheral projections 8 extend outwardly from the sidewall 11A at an interval and two peripheral projections 9 extend outwardly from the opposed sidewall 11B at the interval. Accordingly, the housing 11 has a plane H-shaped form when viewed in a plug-in direction of the connector. The peripheral projections 8 and 9 are plugged in a plug-in space formed by utilizing the thickness of sidewalls of a second connector 30. The projection 8 is used as an extension portion for a cable with a terminal. A terminal holding portion is provided in the housing 11 between the peripheral projections 8 and 9.

Figure 2:
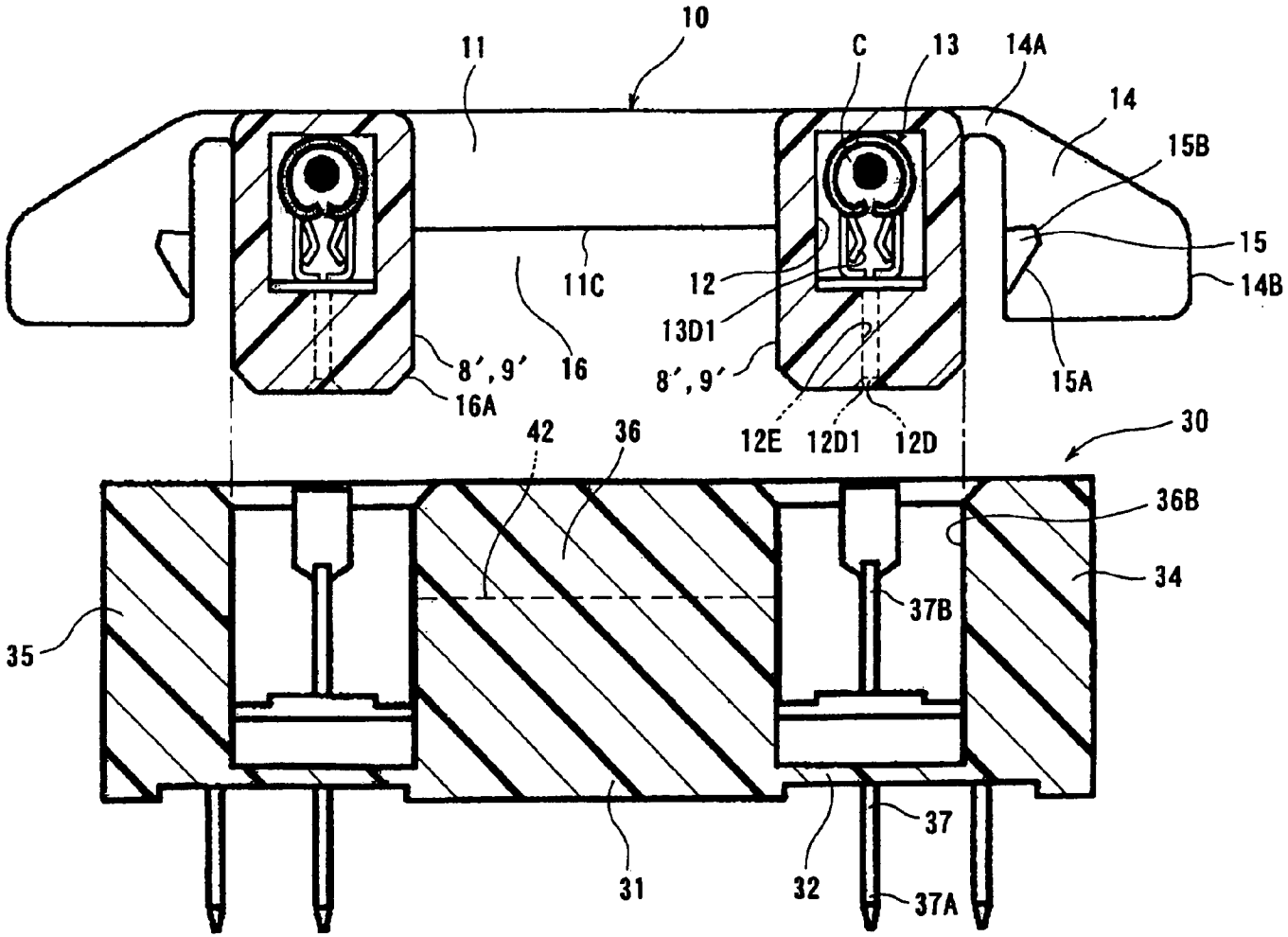
FIG. 2 is a sectional view of the connectors taken along the line II-II of FIG. 1.
Figure 3:
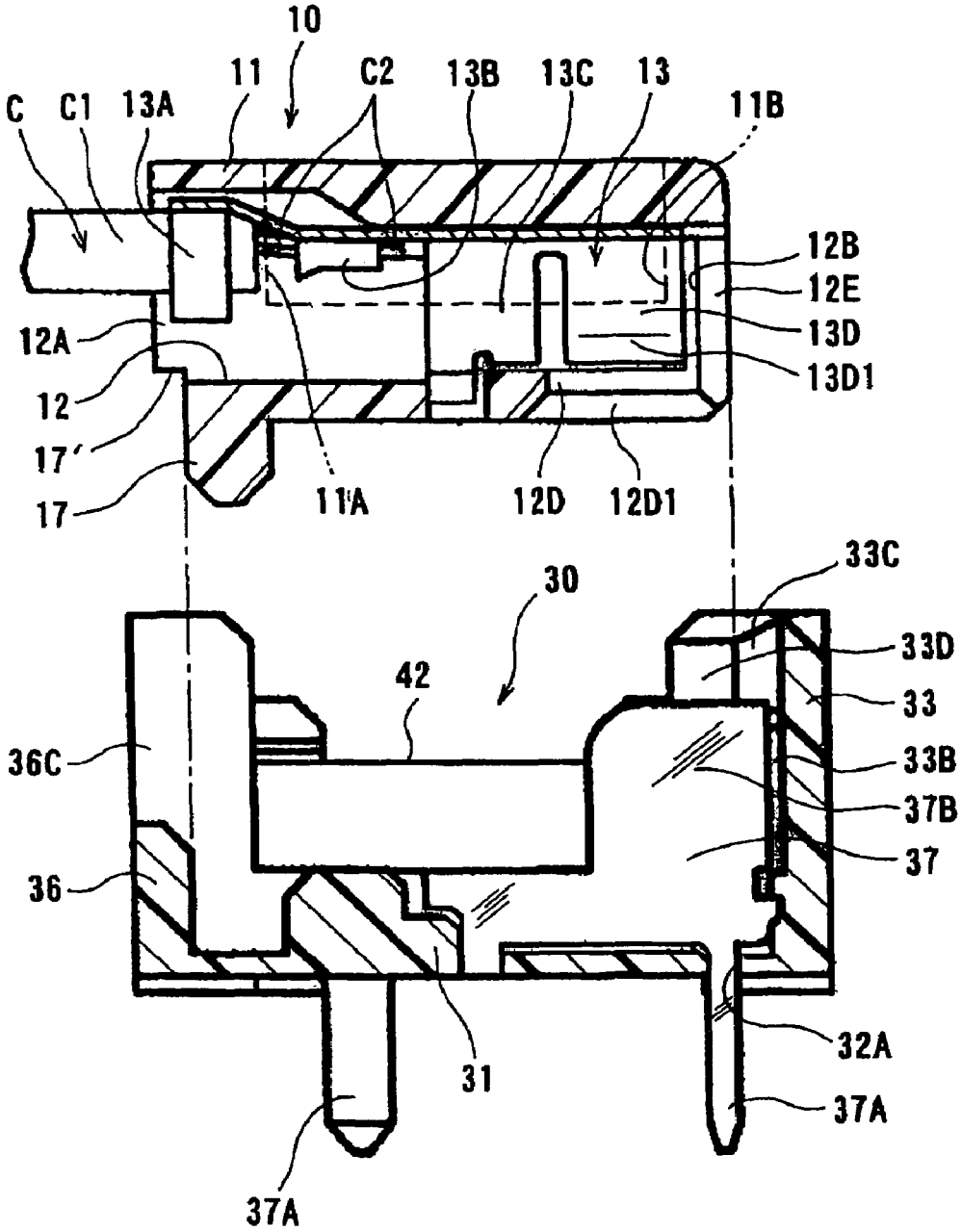
FIG. 3 is a sectional view of the connectors taken along the line III-III of FIG. 1.

In FIGS. 1 and 2, the housing 11 has two holes 12, which are opened to the end of the projections 8. A terminal 13 crimped at the end of a cable C is inserted into the hole 12. As best shown in FIG. 3, an outer covering C1 at the end portion of the cable C is removed by a predetermined length to expose a core wire C2. The terminal 13 comprises a first hold portion 13A for tightly holding the outer covering C2 of the cable C, a second hold portion 13B for tightly holding the core wire C1, a leg portion 13C for stabling the position and posture of the terminal 13 in the hole 12, and a leg-like contact portion 13D for being brought into contact with a plate terminal of the mating connector.

The first and second hold portions 13A and 13B function as a crimp portion for the cable. That is, a pair of legs extending from a U-shaped cable accommodation portion is rounded by caulking or crimping so as to tightly hold the outer covering C1 and core wire C2. The leg portion 13C extends in a direction receding from the core wire C2 and the top end (lower end) of the leg portion 13C is touched with the bottom of the hole 12 to stable the position and posture of the terminal 13. The contact portion 13D provided on the top side (right-hand side) of the terminal 13 extends downwardly like the leg portion 13C. As shown in FIG. 2, a throat portion 13D1 is provided in the contact portion 13D to receive and be brought into resilient-contact with the plate terminal of the mating connector.

In FIG. 3, the hole 12 passes through from an opening 12A provided at a side face of the housing 11 to a sidewall 12B provided at an opposite side face of the housing 11. The leading end of the terminal 13 abuts against the sidewall 12B so as to control the depth of the insertion of the terminal with the cable C. The hole 12 is provided with slits 12D and 12E passing through the lower wall and the opposite side face of the housing 11, respectively. The slits 12D and 12E form flat spaces in parallel to the sheet of FIG. 3 to permit the contact portion of a plate terminal of the mating connector to pass through. The lower end of the slit 12D is tapered to provide a guide portion 12D1 to facilitate of the insertion of the contact portion.

As shown in FIGS. 1 and 2, a pair of resilient arms 14 extends downwardly from the upper edges of sidewalls that extend perpendicular to the longitudinal sidewalls 11A and 11B. The resilient arm 14 is linked to the housing 11 by a base portion 14A. The base portion 14A is made thinner than the other parts to provide resilient deformation. The resilient arm 14 is enlarged toward the end thereof and extends almost up to the lower edge of the housing 11. That is, the resilient arm 14 is placed in the dimension of the housing 11 in the vertical direction. A flat operational portion 14B is provided on a lower outside of the resilient arm 14.

Lock portions 15 project from the side faces of the resilient arm 14. The lock portions 15 are integrally provided with the resilient arm 14 at a position overlapping that of the operational portion 14B in the extension direction of the resilient arm 14. The lock portion 15 is flat at the inner face facing to the housing 11 and tapered at the outer faces 15A and 15B. The two taper faces 15A and 15B are provided such that the thickness of the lock portion 15 decreases on the upper and the lower sides.

A receiving hollow 16 is provided under the housing 11 between inner surfaces 8' and 9' of the peripheral projections 8 and 9. The receiving hollow 16 penetrates in a direction perpendicular to the sheet in FIG. 2 for receiving an intermediate land 42 of the mating connector. The receiving hollow 16 is furnished with a tapered guide portion 16A to receive the intermediate land 42 easily.

A front projection 17 and a stepped portion 17' extend downwardly from the bottom of the projection 8, that is, they are provided at a part of the front portion of the projection 8 in the plug-in direction. A stepped portion 17' is provided on a side of the front projection portion 17. The front projection 17 is inserted into a dent portion 43 provided in the bottom wall of the mating connector 30. In this embodiment, the width of the front projection 17 is made to be within the thickness of the peripheral wall of the mating connector 30 and the length of the front projection 17 is made to be within the depth of the dent portion 43. The dent portion 43 may penetrate into the bottom of the housing 11.

In FIG. 1, a housing 31 of the mating connector or second connector 30 comprises a bottom wall 32 and a peripheral wall including sidewalls 33, 34, 35, and 36 standing upright on the four sides of the bottom wall 32. The sidewalls 33, 34, 35, and 36 form an accommodation space for receiving the first electrical connector 10 and are furnished with tapered guide portions 33A, 34A, 35A, and 36A, respectively, to facilitate the insertion of the first connector 10.

In FIG. 3, two grooves 32A passing through the bottom wall 32 vertically are provided at positions corresponding to the slits 12D of the first connector 10. A plate terminal 37 of the second connector 30 has a connection portion 37A, which is press-fitted into each of the grooves 32A. The terminal 37 comprises a leg-like connection portion 37A, which extends outside the housing 31 to be inserted into and connected with a corresponding hole of a circuit board (not shown) and a plate-type contact portion 37B, which is inserted into the throat portion 13D1 of the terminal 13 of the first connector 10. As shown in FIGS. 1 and 3, the contact portion 37B are placed on the right-hand side of the second connector 30 at a position corresponding to the throat portion 13D1 of the first connector 10 and there is nothing on the left-hand side of the contact portion 37B to form a space for receiving the first connector 10.

As shown in FIG. 1, a pair of the sidewalls 34 and 34' and another pair of the sidewalls 35 and 35' are provided symmetrically and opposing to each other. Cut-off portions 38 and 39, which are opened upwardly for receiving the resilient arms 14 of the first connector 10, are provided between the sidewalls 34 and 34', and 35 and 35', respectively. Engagement hooks 40 and 41 project to the inside of the cut-off portions 38 and 39 from the sidewalls 34, 34', 35, and 35'. The engagement hooks 40 and 41 are provided at positions corresponding to the positions of the lock portions 15 of the resilient arms 14. Tapered guide portions 40A and 41A are provided on the top of the engagement hooks 40 and 41 to facilitate the start of the engagement operation.

A groove portion 33D and a cut-off portion 36B are provided on the sides of the sidewalls 34 and 35 of the accommodation space, respectively. Accordingly, the accommodation space has a plane H shape when viewed in the plug-in direction. The two groove portions 33D are provided in the sidewall 33 to provide plug-in spaces for the projections 9, which are placed at the positions corresponding to the cables C. Namely, the end of the projection 9 is guided and plugged in the groove portion 33D from the above. A ditch 33B is provided in the bottom of the groove portion 33D to guide the plate terminal 37 when the connection portion 37A of the plate terminal 37 is press-fitted in the groove 32A from the above, and to support the terminal 37 after the press-fit. Tapered portion 33C is provided at the upper part of the ditch 33B to make easy the guidance of the terminal 37.

Two cut-off portions 36B are provided in the sidewall 36 and opened upwardly to provide plug-in spaces for the projections 8, which are placed at the positions corresponding to the two cables C extending from the first connector 10. A post 36C is provided between the two cut-off portions 36B and furnished with wall faces 36D. The post 36C is inserted into the receiving hollow 16 of the first connector 10 from the underside with guidance of the front projections 17 and the inner surfaces 8' of the projections 8. Thus, the post 36C can be inserted with guidance of the wide area of the front projections 17 and the inner surfaces of the projections 8. The post 36C and the sidewall 33 are linked with the intermediate land 42 for reinforcement of the second connector 30. The intermediate land 42 is plugged in the receiving hollow 16 that is provided under the first connector.

A dent portion 43 is provided in the bottom of the cut-off portion 36B for receiving the front projection 17 of the first connector 10. The dent portion 43 is provided in the range of the thickness of the sidewall 36 in the thickness direction of the sidewall 32 and within the thickness of the bottom wall 32 in the plugging direction. The dent portion 32 may pass through the housing 41.

The electrical connectors 10 and 30 are electrically connected as described below.

Terminals 13 crimped to the cable C are inserted into the holes 12 (FIGS. 2 and 3).

Figure 4:
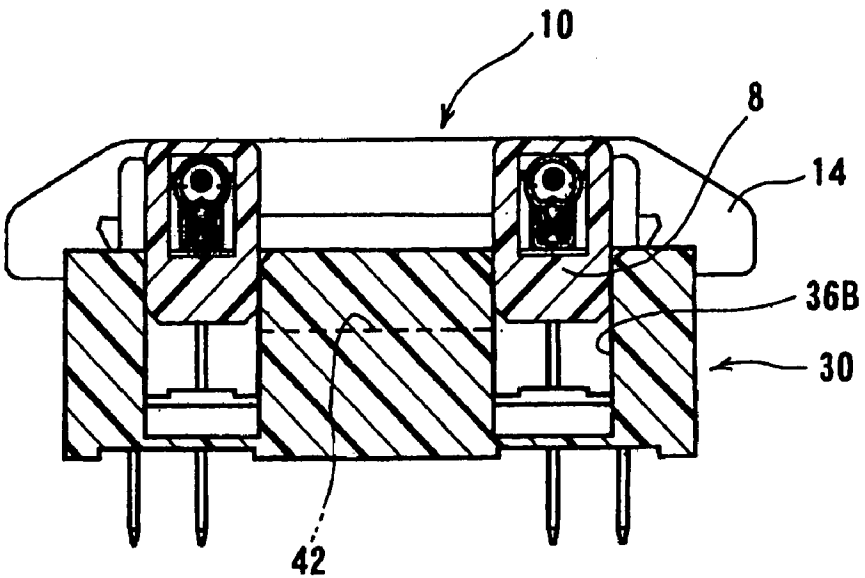
FIGS. 4(A) and 4(B) are sectional views of the connectors upon start of the plug-in operation, wherein 4(A) shows a sectional view at a position corresponding to FIGS. 2 and 4(B) shows a sectional view at a position corresponding to FIG. 3.
Figure 4:
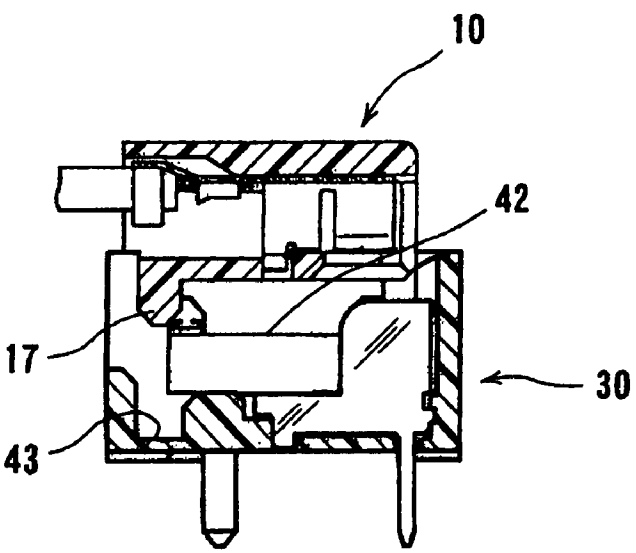

The first connector 10 with the cable C is plugged in the second connector 30. In FIGS. 4(A) and 4(B), the projection 8 and 9 of the first connector 19 are guided and plugged in the cut-off portion 36B and the groove portion 33D of the second connector 30. Also, the intermediate land 42 of the second connector 30 is inserted into the receiving hollow 16 of the first connector 10.

Figure 5:
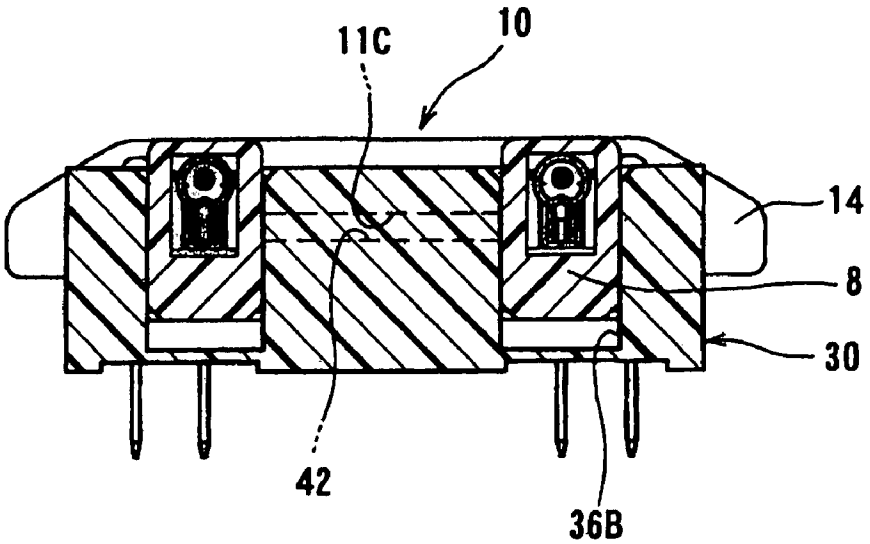
FIGS. 5(A) and 5(B) are sectional views of the connectors in the course of the plug-in, wherein 5(A) shows a sectional view at a position corresponding to FIGS. 2 and 5(B) shows a sectional view at a position corresponding to FIG. 3.
Figure 5:
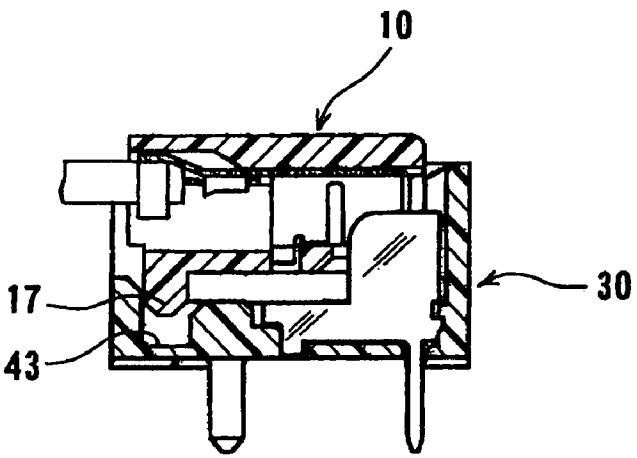
Figure 6:
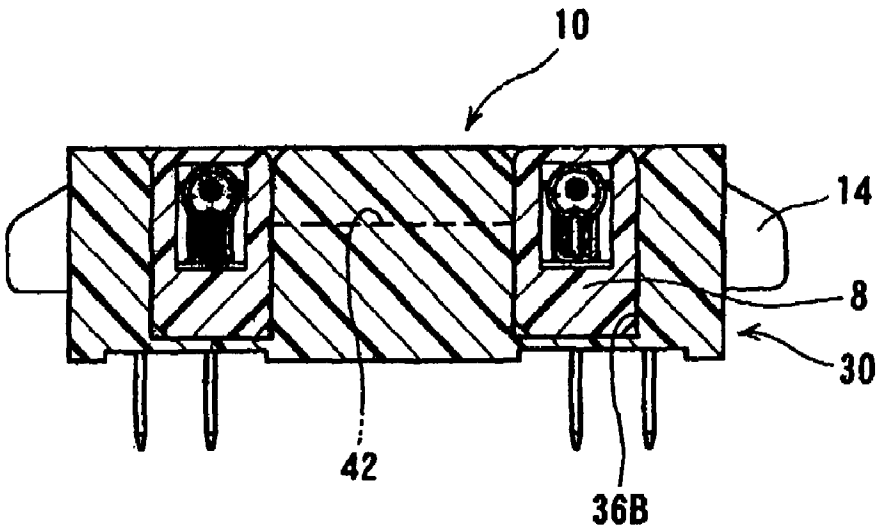
FIGS. 6(A) and 6(B) are sectional views of the connectors upon completion of the plug-in operation, wherein 6(A) shows a sectional view at a position corresponding to FIGS. 2 and 6(B) shows a sectional view at a position corresponding to FIG. 3.
Figure 6:
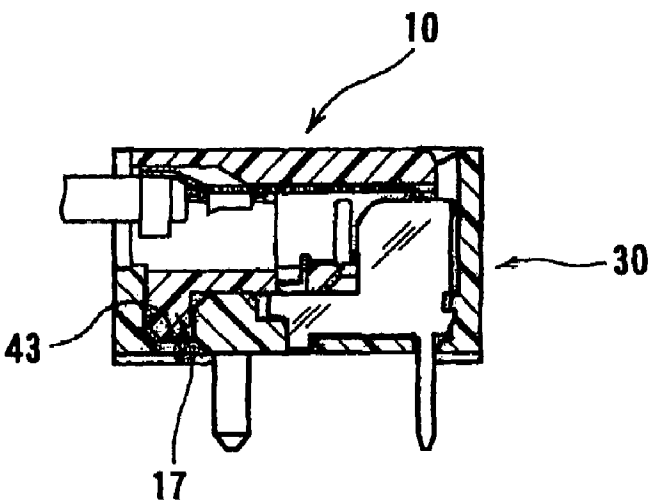

When the plug-in advances further, as shown in FIGS. 5(A) and 5(B), the front projections 17 of the first connector start to be plugged into the dent portions 43 of the second connector. Thus, the plugs-in of the front projections 17 and the peripheral projections 8 and 9 are finished simultaneously.

Since the plug-in of the front projection 17 starts just before the plug-in of the peripheral projections 8 and 9 is finished, the total plug-in length in the plug-in direction becomes large. Accordingly, the posture of the connector 10 becomes stable with respect to the connector 30. Especially, a revolution around an axis in the plug-in direction and an inclination with respect to the axis are eliminated so that the smooth pug-in is performed. Also, since the peripheral projections 8 and 9 and front projections 17 are guided and plugged-in by utilizing the peripheral and bottom walls of the second connector 30, the second connector 30 becomes small.

When the plug-in of the first connector 10 into the second connector 30 is completed, the contact portion 37B of the terminal 37 enters the throat portion 13D1 of the contact portion 13D of the terminal 13 of the first connector 10, making the electrical connection between the connectors 10 and 30.

Also when the plug-in is finished, the cables C provided in the connector 10 extend outwardly from the cut-off portion 36B of the housing 31 of the connector 30, and the resilient arms 14 of the first connector 10 enter the openings 38 and 39 of the connector 30.

The resilient arms 14 is resiliently deformed inwardly to enable the plug-in of the second connector 30 when the lower taper face 15A of the lock portion 15 receives pushing force from the engagement portion 40 of the connector 30. As the plug-in further advances, the engagement portion 40 begins to get contact with the upper taper face 15B. Since the upper taper face 15B is inclined in reverse to the lower taper face 15A in respect to vertical direction, when the upper taper face 15B receives a pushing force from the engagement portion 40, a downward force, which accelerates the plug-in, is produced. Accordingly, the plug-in operation between the connectors 10 and 30 is performed easily.

When the lock portion 15 passes the engagement portion 40, the resilient arm 14 is released from the resilient deformation into the original free position so that the engagement portion 40 engages with the upper face of the lock portion 15 to prevent the coming off of the connector. Thus, the lock is made.

In order to remove the first connector 10 from the second connector 30, the user pushes the operational portion 14B toward the housing 11 so that the resilient arm 42 is resiliently deformed for unlocking. When the displacement amount of the deformation reaches an amount necessary for the lock, that is, an amount equal to the thickness of the lock portion 15, the first connector 10 can be removed from the second connector 30.

The invention claimed is:

1. An electrical connector comprising:

a housing having a peripheral wall, said housing having two peripheral projections on each of opposing sidewalls, making a substantially H-shaped form as viewed from a plug-in direction;

a front projection extending from said peripheral wall in the plug-in direction so that said front projection is plugged in a corresponding dent portion of a mating electrical connector, said front projection being provided at each of a plurality of corners of said housing; and at least one peripheral projection extending from said peripheral wall in a first direction perpendicular to said plug-in direction and to be plugged in a plug-in space provided in a peripheral wall of said mating electrical connector, said peripheral projection on one of the opposing sidewalls forming a cable extension from which a cable extends in said first direction.

2. The electrical connector according to claim 1, wherein said peripheral projection is provided on each of the opposing sidewalls of said housing.

3. The electrical connector according to claim 2, wherein said peripheral projection on one of the opposing sidewalls makes a cable extension from which a cable extends in said first direction.

4. The electrical connector according to claim 2, wherein said peripheral projection is provided at each of two positions spaced from each other in a second direction perpendicular to both the first and plug-in directions.

5. The electrical connector according to claim 4, wherein said peripheral projection on one of the opposing sidewalls makes a cable extension from which a cable extends in said first direction.

6. An electrical connector, comprising:

a housing having a peripheral wall, said peripheral wall having a plug-in space for receiving a peripheral projection of a mating electrical connector, said housing having two groove portions and two cut-off portions on opposing sidewalls so that said plug-in space makes an H-shaped form as viewed in a plug-in direction;

at least one cut-off portion passing through said peripheral wall for receiving a cable of the mating electrical connector that extends in a first direction perpendicular to a plug-in direction; and a dent portion provided in a bottom of said cut-off portion for receiving a front projection of said mating electrical connector, said dent portion being provided in each of a plurality of corners of said housing.

7. The electrical connector according to claim 6, wherein said plug-in space is provided in each of the opposing sidewalls.

8. The electrical connector according to claim 7, wherein said plug-in space is provided at each of two positions spaced in a widthwise direction of said sidewalls.

9. The electrical connector according to claim 8, wherein said plug-in space is a groove portion extending outwardly from an inside of one of said sidewalls or a cut-off portion passing through the other sidewall that is opposed to said one sidewall.

* * * * *